United States Patent [19]

Ketchum

[11] Patent Number: 4,553,751

[45] Date of Patent: Nov. 19, 1985

[54] REBOUND APPARATUS

[76] Inventor: John L. Ketchum, 3200 SW. 94th Pl., Miami, Fla. 33165

[21] Appl. No.: 667,800

[22] Filed: Nov. 2, 1984

[51] Int. Cl.[4] ..... A63B 69/40

[52] U.S. Cl. ..... 273/26 A; 273/407; 273/395

[58] Field of Search ..... 273/26 A, 26 R, 29 A, 273/348, 395, 181 R, 181 J, 183 R, 407, 410, 374, 376; 272/65

[56] References Cited

U.S. PATENT DOCUMENTS

| | | | |
|---|---|---|---|
| 2,247,501 | 7/1941 | Jenks et al. | 273/181 J |
| 2,482,234 | 9/1949 | Barker | 273/26 A |
| 2,932,516 | 4/1960 | Penner | 273/407 |
| 2,944,816 | 7/1960 | Dixon | 273/26 A |
| 3,206,196 | 9/1965 | Jackson | 273/26 A |
| 3,368,814 | 2/1968 | Kolwicz | 272/65 |
| 3,408,071 | 10/1968 | Lundy | 273/26 A |
| 3,427,026 | 2/1969 | Mahoney | 273/26 A |
| 3,502,330 | 3/1970 | Cheftel | 272/65 |
| 3,511,503 | 5/1970 | Volpe | 273/26 A |
| 4,199,141 | 4/1980 | Garcia | 273/26 A |
| 4,258,924 | 3/1981 | Ketchun | 273/395 |
| 4,421,318 | 12/1983 | Sverdlik et al. | 273/26 A |

OTHER PUBLICATIONS

"Popular Mechanics", 8/62, pp. 128–129.

*Primary Examiner*—Richard C. Pinkham
*Assistant Examiner*—T. Brown
*Attorney, Agent, or Firm*—Oltman and Flynn

[57] ABSTRACT

An angularly adjustable rebound apparatus for athletic training. A generally rectangular front frame carries a rebound net and is spring-mounted on a similar back frame. Behind the back frame a rigid support base presents generally triangular opposite sides, each having a horizontal bottom side rail, a front side rail extending up from the front end of the corresponding bottom side rail, and a diagonal side rail extending down from the upper end of the front side rail to the rear end of the bottom side rail. Each bottom side rail has top openings at intervals along its length for receiving a locking pin on a corresponding slider. Each slider carries the socket of a ball-and-socket joint which connects the slider to the rear end of a rigid rod which is pivotally connected at its front end to the lower end of the back frame.

8 Claims, 2 Drawing Figures

REBOUND APPARATUS

SUMMARY OF THE INVENTION

This invention relates to a rebound apparatus for athletic training purposes, such as in the sports of soccer, ice hockey, field hockey and baseball.

A principal object of this invention is to provide a novel rebound apparatus of improved versatility which adapts it for use in training athletes in a variety of different sports.

Another object of this invention is to provide such a rebound apparatus having a flexible and resilient rebound panel which can be adjusted to many different angular positions, depending upon the particular training exercise for which it is being used.

Other objects of this invention will appear from the following description and appended claims, reference being had to the accompanying drawings forming a part of this specification wherein like reference characters designate corresponding parts in the several views.

Preferably, the present rebound apparatus comprises a rigid support base, a rear frame pivotally suspended at the top from the support base, adjustment devices acting between the support base and the lower end of the rear frame to adjust its angular position, a front frame which is spring-mounted in front of the rear frame, and a rebound member in the form of a flexible and resilient net carried by the front frame.

Figure 1:
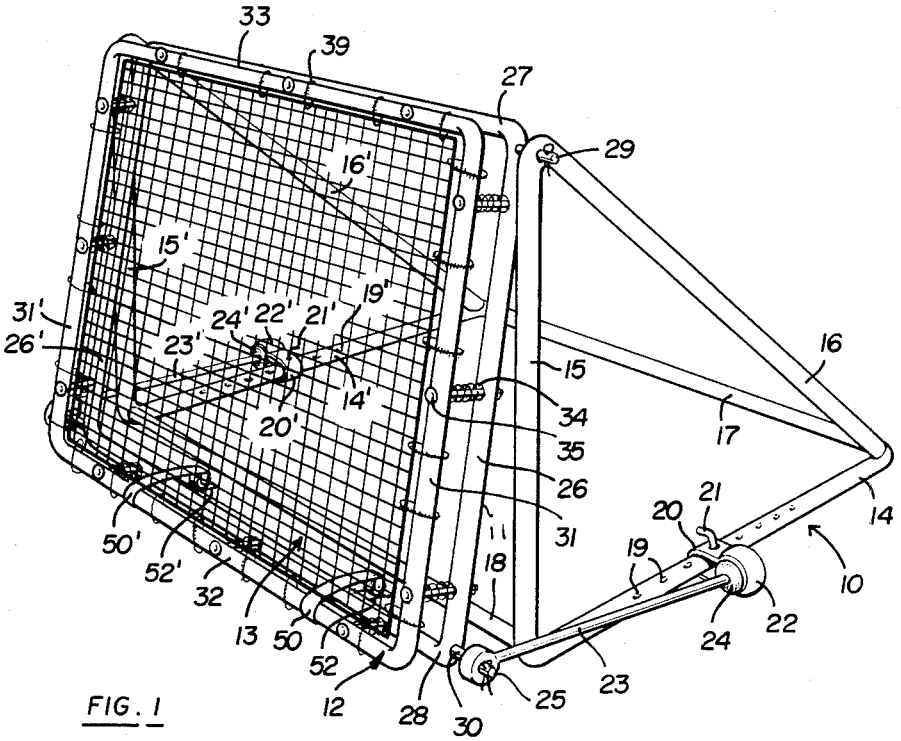
FIG. 1 is a front perspective view.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

In broad outline the present apparatus comprises a support base 10 on the back, a rear frame 11 on the front of the support base, a front frame 12 in front of the rear frame, and a rebound screen 13 carried by the front frame.

Viewed from either side, the support base 10 is generally triangular. On the right side in FIG. 1 it presents a horizontal bottom side rail 14, a front side rail 15 extending vertically up from the front end of the bottom side rail, and a diagonal side rail 16 extending from the upper end of front side rail 15 downward and rearward to the rear end of bottom side rail 14. On the left side in FIG. 1 the support base has an identical arrangement of a bottom side rail 14', a front side rail 15' and a diagonal side rail 16'. A bottom back rail 17 extends horizontally between the rear ends of the bottom side rails 14 and 14'. A bottom front rail 18 extends horizontally between the front ends of bottom side rails 14 and 14'. Preferably all of these rails in the support base are of rigid, hollow, metal tubing.

The bottom rail 14 on the right side has several vertical openings 19 on the top which are spaced apart at suitable intervals along its length. The left bottom rail 14' has similar openings 19' at the same intervals. A slider 20 presesnts a U-shaped inner segment which extends snugly but slidably around the inside of the bottom side rail 14. A locking pin 21 on this slider is insertable down into the top opening 19 where the slider is positioned to releasably lock the slider in that position on the bottom side rail 14. On the outside, this slider carries a socket 22 with a forwardly-facing, spherical recess. An elongated, rigid, adjusting rod 23 carries a ball 24 on its back end which is snugly but rotatably received in the slider socket 22. On its front end this rod carries a collar 25 formed with a horizontal bore whose axis extends parallel to the front bottom rail 18 of the support base. A similar assembly of a slider 20', locking pin 21', socket 22', rod 23', ball 24' and front end collar (not shown) is located on the left side of the support base at the bottom.

With this arrangement, after releasing the locking pins 21 and 21' from the respective bottom side rail openings 19 and 19' which receive them, the sliders 20 and 20' can be adjusted forward or rearward to a new position along the respective bottom rails 14 and 14', after which the locking pins can be inserted in the bottom rail openings at this new location.

The rear frame 11 is generally rectangular in outline and is dimensioned to fit inside the front of the support frame 10 between the bottom front rail 18 and the upstanding front side rails 15 and 15'. The rear frame has right and left rails 26 and 26', a horizontal top rail 27 extending between the upper ends of rails 26 and 26', and a horizontal bottom rail 28 extending between their lower ends. When fully retracted to a vertical position, shown in phantom in FIG. 2, the rear frame 11 has its bottom rail 28 directly above the bottom front rail 18 of the support base 10 and its side rails 26 and 26' just inside the corresponding front side rails 15 and 15' of the support base. A horizontal pivot pin 29 on the top right corner of the rear frame 11 is rotatably received in a corresponding opening in the same corner of the support base 10. A similar pivotal mounting (which does not appear in the drawing) is provided at the top left corner of the assembly. With this arrangement the rear frame is pivotally adjustable about a horizontal axis at the top of the assembly.

At the lower right corner of the rear frame 11 a horizontal pivot pin 30 is rotatably received in the bore of the collar 25 on the front end of adjusting rod 23. An identical pivotal coupling (not shown) is provided between the lower left corner of the rear frame 11 and the front end of the adjusting rod 23' on that side.

Figure 2:
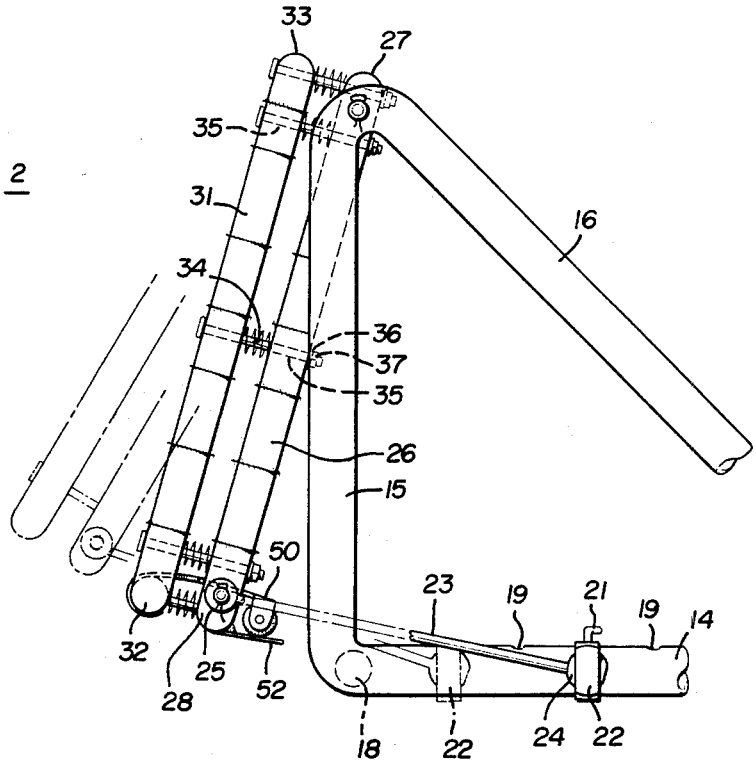
FIG. 2 is a side elevation showing all but the rear extremity of the present apparatus.

It will be apparent that by adjusting the sliders 20 and 20' forward, the rear frame 11 will be displaced counterclockwise in FIGS. 1 and 2 to a position at a greater angle from the vertical. Conversely by moving the sliders rearward the rear frame 11 will pivot to a more vertical position.

The front frame 12 is the same shape and size as the rear frame 11, presenting right and left side rails 31 and 31', a horizontal bottom rail 32, and a horizontal top rail 33. Coil springs 34 are under compression between the front and rear frames to resiliently cushion the rearward displacement of the front frame. In the particular arrangmenet shown, there are three such springs between each side, top and bottom rail of the front frame and the corresponding rail of the rear frame. The compression of these springs is selectively adjustable by means of corresponding bolts 35 (FIG. 2), each extending through aligned openings in the front and rear frames. Each adjusting bolt has an enlarged head on its front end which engages the front frame 12 at the front and a screw-threaded back end passing behind the rear frame and receiving a washer 36 and clamping nut 37.

The rebound panel 13, which preferably is a flexible and resilient net, extends between the side, bottom and top rails of the front frame. The net is suitably attached to all of these rails of the front frame at intervals along the length of each rail by elastic elements 39 which are stretched to hold the net relatively taut, normally.

Tongue and roller units 50 and 50' are mounted on the bottom rail 32 of the front frame 12, and the rollers of these units ride on guides 52 and 52' mounted on the bottom rail 28 of the rear frame 11 for helping to support the front frame 12.

It will be apparent that the plane of the rebound net 13 can be adjusted to several angular positions ranging from a vertical position to a position at about 30 degrees from the vertical, with the lower end forward. This adjustability enables the present rebound apparatus to be used in a large variety of athletic practice situations. For example, it can be used by a soccer player to practice head, shoulder, knee or chest shots, as well as foot shots. In baseball, it can be used for pitching, fielding and catcher's practice.

I claim:

1. A rebound apparatus comprising:

a support base having a pair of rigid, laterally spaced, opposite, upwardly extending side members;

frame means extending between said side members at the front of said support base and pivotally mounted on the upper ends of said side members;

means for selectively adjusting the fore-and-aft position of the lower end of said frame means with respect to said support base;

and a rebound member on said frame means;

said frame means comprising a rear frame horizontally pivoted at the top to said support base, a front frame positioned in front of said rear frame and carrying said rebound member, and springs engaged between said front and rear frames and permitting rearward displacement of said front frame toward said rear frame in response to an impact on said rebound member;

said support base comprising a pair of rigid, laterally spaced, opposite, bottom members extending rearward respectively from the lower ends of said side members, each of said bottom members having a plurality of openings spaced apart along its length rearward;

and said means for adjusting said frame means comprising a pair of sliders slidably adjustable respectively along said bottom members and a locking member on each slider selectively insertable into said openings in said bottom member, a pair of rigid members respectively extending forward from said sliders and pivotally coupled to said rear frame at its lower end, and a respective ball-and-socket joint connecting the rear end of each said rigid member to the corresponding slider.

2. A rebound apparatus according to claim 1 wherein:

said support base has opposite triangular sides having said side members at the front extending up from the front ends of said bottom members and diagonal members respectively extending from the upper ends of said side members to the rear ends of said bottom members, a front bottom member extending between the front ends of said bottom members, and a rear bottom member extending between the rear ends of said bottom members.

3. A rebound apparatus comprising:

a support base having a pair of rigid, laterally spaced, opposite, upwardly extending side members;

frame means extending between said side members at the front of said support base and pivotally mounted on the upper ends of said side members;

means for selectively adjusting the fore-and-aft position of the lower end of said frame means with respect to said support base;

and a rebound member on said frame means;

said support base comprising a pair of rigid, laterally spaced, opposite, bottom members extending rearward respectively from the lower ends of said side members, each of said bottom members having a plurality of openings spaced apart along its length rearward;

and said means for adjusting said frame means comprising a pair of sliders slidably adjustable respectively along said bottom members and a locking member on each slider selectively insertable into said openings in said bottom member, a pair of rigid members respectively extending forward from said sliders and pivotally coupled to said frame means at its lower end, and a respective ball-and-socket joint connecting the rear end of each said rigid member to the corresponding slider.

4. A rebound apparatus comprising:

a support base having a pair of rigid, laterally spaced, opposite, upwardly extending side members;

frame means extending between said side members at the front of said support base and pivotally mounted on the upper ends of said side members;

means for selectively adjusting the fore-and-aft position of the lower end of said frame means with respect to said support base;

and a rebound member on said frame means;

said support base having opposite triangular sides having said side members at the front, a pair of rigid, laterally spaced, opposite, bottom members extending rearward respectively from the lower ends of said side members and each having a plurality of openings spaced apart along its length rearward, diagonal members respectively extending from the upper ends of said side members rearward and downward to the rear ends of said bottom members, a front bottom member extending between the front ends of said bottom members, and a rear bottom member extending between the rear ends of said bottom members;

and said means for adjusting said frame means comprising a pair of sliders slidably adjustable respectively along said bottom members and a locking member on each slider selectively insertable into said openings in said bottom member, a pair of rigid members respectively extending forward from said sliders and pivotally coupled to said frame means at its lower end, and a respective ball-and-socket joint connecting the rear end of each said rigid member to the corresponding slider.

5. A rebound apparatus comprising:

a support base having a pair of laterally spaced, opposite sides each having a horizontal bottom side rail, a front side rail extending up from the front end of the bottom side rail and a diagonal side rail extending between the top of the front side rail and the rear end of the corresponding bottom side rail, each bottom side rail having a plurality of openings spaced apart along its length, said support base also having a bottom front rail extending horizontally between the front ends of said bottom side rails, and a bottom back rail extending horizontally between the rear ends of said bottom side rails;

a rear frame having opposite side members spaced apart laterally to fit inside said front side rails of the support base and pivotally connected at their upper ends to the upper ends of said front side rails of the support base;

a front frame positioned in front of said rear frame;

coil springs engaged under compression between said front and rear frames;

guides on said rear frame and tongue and roller units on said front frame riding on said guides for helping to support said front frame;

a rebound member carried by said front frame;

a pair of sliders slidably adjustable respectively along said bottom side rails;

a pair of locking pins respectively mounted on said sliders and selectively insertable into said openings in said bottom side rails to lock said sliders in place thereon;

a pair of sockets respectively connected to said sliders and located laterally outward from the respective bottom side rails of the support base;

and a pair of rigid rods respectively connected pivotally to the lower ends of said side members of the rear frame and each having a ball seated in the socket on that side of the support base.

6. A rebound apparatus according to claim 5 wherein:

said rebound member is a flexible and resilient screen extending across said front frame.

7. A rebound apparatus according to claim 6 and further comprising:

means for selectively adjusting the compression of said springs between said front and rear frames.

8. A rebound apparatus comprising:

a support base having a pair of rigid, laterally spaced, opposite, upwardly extending side members;

frame means extending between said side members at the front of said support base and pivotally mounted on the upper ends of said side members;

means for selectively adjusting the fore-and-aft position of the lower end of said frame means with respect to said support base;

and a rebound member on said frame means;

said support base comprising a pair of rigid, laterally spaced, opposite, bottom members extending rearward respectively from the lower ends of said side members, each of said bottom members having a plurality of recesses spaced apart along its length rearward;

and said means for adjusting said frame means comprising a pair of sliders slidably adjustable respectively along said bottom members and a lock member on each slider selectively insertable into said recesses in said bottom member, and a pair of rigid members pivotally coupled respectively to said sliders and extending forward from said sliders and pivotally coupled to said frame means at its lower end.

* * * * *